US010392972B2

(12) United States Patent
Flatscher et al.

(10) Patent No.: US 10,392,972 B2
(45) Date of Patent: Aug. 27, 2019

(54) LINER ELEMENT FOR A TURBINE INTERMEDIATE CASE

(71) Applicant: MTU Aero Engines AG, Munich (DE)

(72) Inventors: Thomas Flatscher, Munich (DE); Alois Eichinger, Pfaffenhofen (DE); Wolfgang Bickmeier, Petershausen (DE); Manfred Feldmann, Eichenau (DE); Daniel Kirchner, Munich (DE); Johannes Geisler, Munich (DE)

(73) Assignee: MTU Aero Engines AG, Munich (DE)

( * ) Notice: Subject to any disclaimer, the term of this patent is extended or adjusted under 35 U.S.C. 154(b) by 27 days.

(21) Appl. No.: 15/653,777

(22) Filed: Jul. 19, 2017

(65) Prior Publication Data

US 2018/0038244 A1 Feb. 8, 2018

(30) Foreign Application Priority Data

Jul. 27, 2016 (DE) ..... 10 2016 213 810

(51) Int. Cl.
*F01D 25/24* (2006.01)

(52) U.S. Cl.
CPC ..... *F01D 25/24* (2013.01); *F05D 2220/323* (2013.01); *F05D 2240/12* (2013.01);
(Continued)

(58) Field of Classification Search
CPC .. F01D 25/24; F05D 2260/96; F05D 2250/75; F05D 2260/941; F05D 2240/12;
(Continued)

(56) References Cited

U.S. PATENT DOCUMENTS 4,471,609 A * 9/1984 Porter ..... B64D 27/18 244/117 A
4,725,334 A * 2/1988 Brimm ..... C23F 1/04 216/34

(Continued)

FOREIGN PATENT DOCUMENTS

CN 105756726 7/2016
DE 1601548 2/1970

(Continued)

*Primary Examiner* — Hung Q Nguyen
(74) *Attorney, Agent, or Firm* — Davidson, Davidson & Kappel, LLC

(57) ABSTRACT

A liner element of a hot-gas-conveying duct of a turbine intermediate case of a gas turbine, in particular of an aircraft gas turbine, the liner element includes a central portion having at least one first reinforcement portion projecting in a direction away from the duct and extending substantially straight between an axial forward end and an axial rearward end; at least one of the two axial ends being adjoined by a second reinforcement portion projecting in a direction away from the duct and extending inclinedly or curvedly relative to the straight-line extent of the first reinforcement portion; the first reinforcement portion and the second reinforcement portion together forming a reinforcing element; the entire reinforcing element being disposed within the outer surface of the central portion, in particular in such a way that the reinforcing element is spaced apart from the first connecting portion and from the second connecting portion.

13 Claims, 3 Drawing Sheets

(52) U.S. Cl.
CPC ..... *F05D 2240/14* (2013.01); *F05D 2250/75* (2013.01); *F05D 2260/941* (2013.01); *F05D 2260/96* (2013.01)

(58) Field of Classification Search
CPC ..... F05D 2220/323; F05D 2240/14; F05D 2240/15
See application file for complete search history.

(56) References Cited

U.S. PATENT DOCUMENTS 4,920,742 A * 5/1990 Nash ..... F01D 25/162 415/116
4,987,736 A 1/1991 Ciokajlo et al.
5,144,795 A * 9/1992 Field ..... F02K 1/822 239/127.3
5,357,744 A 10/1994 Czachor et al.
5,483,792 A 1/1996 Czachor et al.
5,485,723 A * 1/1996 McCoy ..... F01D 21/045 415/200
5,605,438 A * 2/1997 Burdgick ..... F01D 25/145 415/182.1
7,581,385 B2 * 9/2009 Farah ..... F02K 1/822 428/116
7,814,753 B2 * 10/2010 Farah ..... F01D 25/30 239/265.35
7,942,004 B2 * 5/2011 Hodder ..... F23M 5/02 52/509
8,021,109 B2 * 9/2011 Kneeland ..... F01D 25/14 165/181
8,071,313 B2 12/2011 Cucuzza et al.
8,128,353 B2 * 3/2012 Flanagan ..... F01D 25/265 415/13
8,182,210 B2 5/2012 Khanin et al.
8,272,203 B2 * 9/2012 Derenes ..... F01D 25/24 415/213.1
8,616,839 B2 12/2013 Ballard, Jr. et al.
9,498,850 B2 * 11/2016 Denis ..... B23K 31/02
2005/0254919 A1 11/2005 Wunderlich et al.
2005/0254939 A1 11/2005 Wunderlich et al.
2011/0283711 A1 * 11/2011 Petersson ..... F01D 9/041 60/796
2012/0034076 A1 * 2/2012 Xie ..... F01D 21/045 415/200
2014/0003922 A1 * 1/2014 Daniels ..... F01D 25/24 415/182.1

FOREIGN PATENT DOCUMENTS

DE 3940423 6/1990
DE 102009044089 4/2010
DE 102010016532 11/2010
DE 102012200539 7/2013
GB 1137940 12/1968
WO WO2009/000801 12/2008

* cited by examiner

LINER ELEMENT FOR A TURBINE INTERMEDIATE CASE

This claims the benefit of German Patent Application DE102016213810.3, filed Jul. 27, 2016 and hereby incorporated by reference herein.

The present invention relates to a liner element of a hot-gas-conveying duct of a turbine intermediate case of a gas turbine, in particular of an aircraft gas turbine, the liner element including a first, axially forward connecting portion and a second, axially rearward connecting portion, a central portion connected to the first connecting portion and the second connecting portion and located axially therebetween; the central portion having an outer surface facing away from the duct; and the first connecting portion being couplable to axially forward components of the gas turbine, and the second connecting portion being couplable to axially rearward components of the gas turbine.

Directional words such as "axial," "axially," "radial," "radially," and "circumferential" are taken with respect to the machine axis of the turbine intermediate case or gas turbine, unless the context explicitly or implicitly indicates otherwise.

In the context of the present invention, the term "turbine intermediate case" includes casings which directly adjoin the casing of a turbine stage in the axial direction of the gas turbine, and preferably are disposed between two turbine stages. The gas turbine may have two or more turbine stages, depending on its design. Thus, the term "turbine case" includes in particular also a so-called "turbine center frame."

BACKGROUND

It is known to provide stiffening ribs on components, in particular liner elements, of turbine intermediate cases or gas turbines. Generally, the known stiffening ribs extend in the axial direction or in the circumferential direction. The known stiffening ribs are coupled to edge portions of the respective component, so that the stiffening ribs generally extend along the entire component in the axial direction or in the circumferential direction. Such stiffening ribs do allow high stiffness to be achieved for the components; however, high thermal stresses are induced in the component due to the connection of the stiffening ribs to the edge portions. Moreover, such known stiffening ribs require a large amount of material.

SUMMARY OF THE INVENTION

It is-an object of the present invention to provide a liner element for an annular duct of a turbine intermediate case, which liner element provides sufficient stiffness using little material and makes it possible to reduce thermally induced stresses.

To achieve this object, it is proposed for the central portion to have at least one first reinforcement portion projecting in a direction away from the duct and extending substantially straight between an axial forward end and an axial rearward end; at least one of the two axial ends being adjoined by a second reinforcement portion projecting in a direction away from the duct and extending inclinedly or curvedly relative to the straight-line extent of the first reinforcement portion; the first reinforcement portion and the second reinforcement portion together forming a reinforcing element; the entire reinforcing element being disposed within the outer surface of the central portion, in particular in such a way that the reinforcing element is spaced apart from the first connecting portion and from the second connecting portion.

Thus, the first reinforcement portion, which extends substantially straight between the axial forward end and the axial rearward end, has a main direction of extension having an axial directional component; i.e., a directional component oriented in the axial direction of the turbomachine. Preferably, the main direction of extension of the first reinforcement portion has no circumferential directional component (i.e., directional component in the circumferential direction of the turbomachine), or a circumferential directional component that is smaller than the axial directional component.

By arranging two reinforcement portions in such a way that the second reinforcement portion extends inclinedly or curvedly relative to the first straight reinforcement portion and that the two reinforcement portions together form the reinforcing element, it is possible to achieve a material-saving design. Moreover, due to the distances from the connecting portions, it is possible to prevent constraints, and thus to prevent thermally induced stresses.

A free end of the first reinforcement portion which is not connected to a second reinforcement portion may be configured to taper at least in the radial direction such that the first reinforcement portion merges substantially continuously into the outer surface of the central portion. Thus, the free end of the first reinforcement portion forms a kind of seamless or smooth transition between the first reinforcement portion and the outer surface of the central portion.

The second reinforcement portion may be configured to be substantially symmetrical with respect to the first reinforcement portion connected thereto, in particular such that the first reinforcement portion and the second reinforcement portion form a Y-shaped reinforcing element. The free ends of the second reinforcement portion may in particular be oriented such that they point toward mounting points of the liner element, at which the liner element is connected to other structures of the turbine intermediate case or gas turbine. The symmetrical, in particular Y-like configuration is also particularly suitable for optimally distributing the acting forces and stresses.

The second reinforcement portion may have two free ends which are configured to taper at least in the radial direction such that the second reinforcement portion merges substantially continuously into the outer surface of the central portion. Thus, the entire reinforcing element, if formed, for example, by a first reinforcement portion and a second reinforcement portion, has three free ends, which merge substantially seamlessly or smoothly into the outer surface of the central portion.

The first reinforcement portion may be located substantially centrally on the central portion with respect to the circumferential direction. In particular, the central region of the central portion is subject to the largest deformations, in particular bending loads, caused by pressure differentials between the hot gas flowing in the annular duct and the secondary air system outside the annular duct. Accordingly, this central region should preferably be reinforced to counteract bending or bulging out of the central portion in the radial direction.

The first connecting portion, the second connecting portion and the central portion may be curved at least in the circumferential direction. On the one hand, the curvature serves to adapt the liner element with regard to the assembled condition of a turbine intermediate case. Generally, the liner of the annular duct is formed by a plurality of adjacent liner elements, so that it is advantageous if the individual liner elements already have a corresponding curvature.

The reinforcing element may be spaced in the circumferential direction from lateral edge portions of the liner element, which project from the outer surface of the central portion at least in the radial direction. Generally, such edge portions form the transition to a component which is adjacent thereto in the circumferential direction, in particular an adjacent liner element. If, in addition to the its spacing from the first and second connecting portions, the reinforcing element is also spaced from these edge portions, the entire reinforcing element is located only in the region of the (outer) surface of the central portion. This allows the central portion to be reinforced in the desired manner without thermally induced stresses being transmitted, to a great extent, to the edge portions or the two connection portions.

A second reinforcement portion may be disposed at each end of the first reinforcement portion, thereby forming a kind of a double Y or a kind of a stick figure without a head, with legs spread and arms raised. In this configuration, the first reinforcement portion is disposed centrally and the two second reinforcement portions each have two arms extending away from the first reinforcement portion.

The entire reinforcing element may be formed in one piece with the central portion of the liner element. This can be accomplished by using a suitable casting mold in which the reinforcing element is already accounted for. Preferably, the liner element is produced using a casting process. However, alternatively, the component could also completely or partly be produced using an additive process. Thus, for example, the reinforcing element may be formed on the outer surface of the central portion by laser build-up welding.

The present invention also relates to a turbine intermediate case for a gas turbine, in particular an aircraft gas turbine, having a hot-gas-conveying annular duct; the annular duct having a plurality of the above-described liner elements at the radially outer periphery thereof. The liner elements may be arranged to adjoin one another in the circumferential direction. Alternatively, liner elements of the above-described type and differently configured liner elements may be arranged alternately in the circumferential direction.

BRIEF DESCRIPTION OF THE DRAWINGS

The present invention will now be described with reference to the accompanying figures by way of example and not by way of limitation.

DETAILED DESCRIPTION

Figure 1:
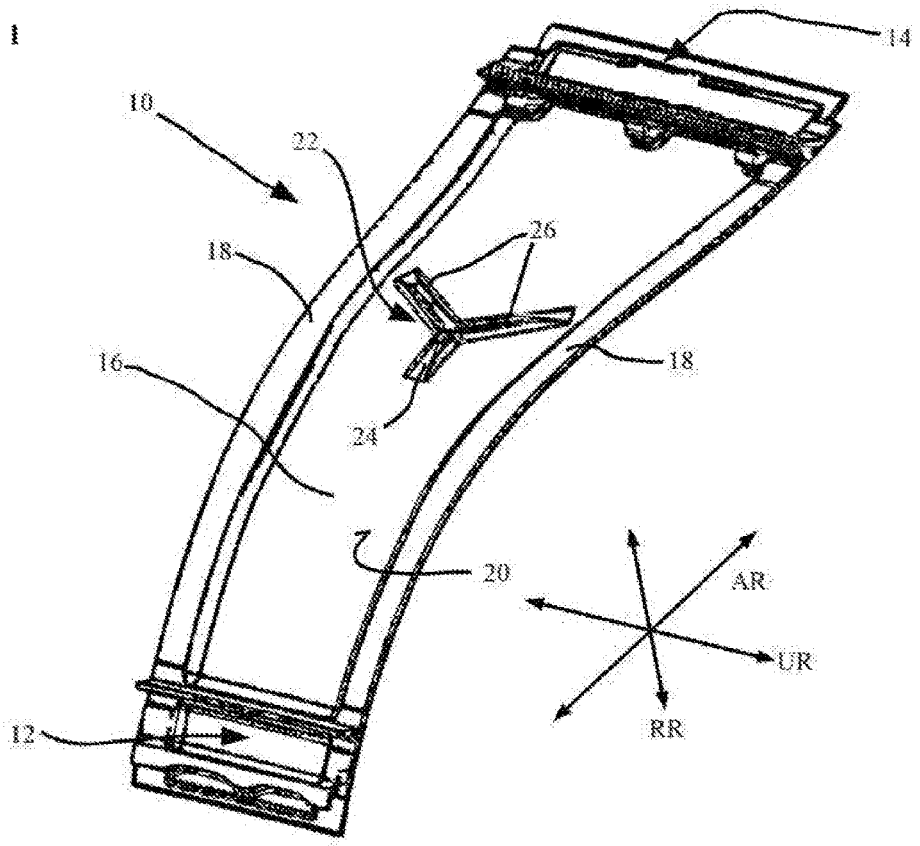
FIG. 1 is a simplified perspective view of a liner element having a reinforcing element.
Figure 5:
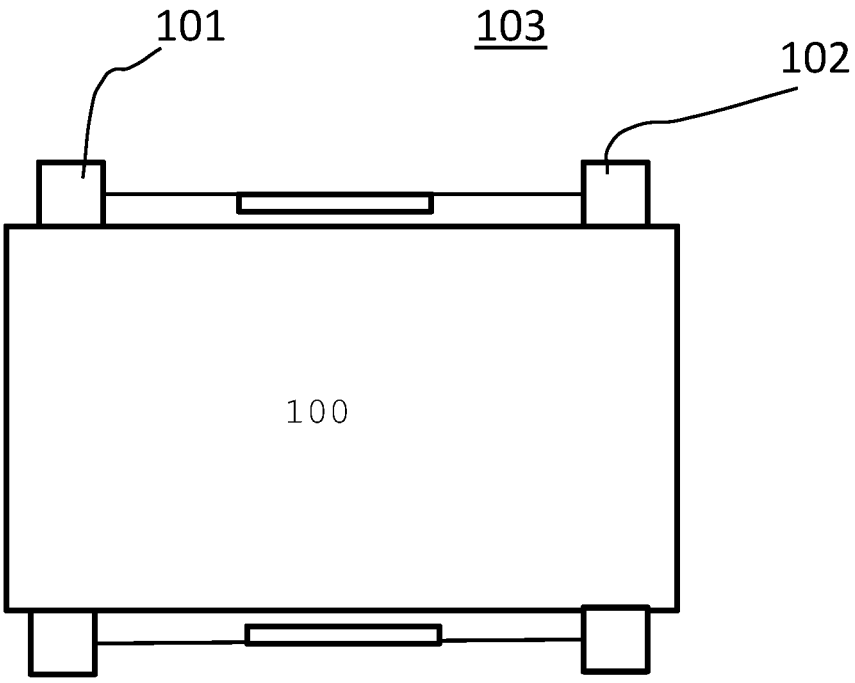
FIG. 5 is a highly schematic view of a turbine intermediate case.

FIG. 1 shows, in simplified, schematic perspective view, a liner element 10 of a turbine intermediate case (See FIG. 5). The present example, as illustrated in FIG. 1, shows a so-called "inner duct panel;" i.e., a liner element which is adapted to radially inwardly bound the hot gas duct of the turbine intermediate case. FIG. 1 shows the surface of the liner element which faces away from the hot gas duct and which, when installed, faces radially inwardly relative to the machine axis of the gas turbine. Liner element 10 has a first, axially forward connecting portion 12 and a second, axially rearward connecting portion 14. These two connecting portions 12, 14 serve to connect liner element 10 to axially adjoining components 101, 102 of the turbine intermediate case 100 or of an associated gas turbine, as shown schematically in FIG. 5. A central portion 16 extends between first connecting portion 12 and a second connecting portion 14 along axial direction AR. In circumferential direction UR, central portion 16 is bounded by edge portions 18. Central portion 16 has an outer surface 20. Outer surface 20 is in particular bounded by the two edge portions 18, which project from outer surface 20 in the radial direction, and by the two connecting portions 12, 14.

A reinforcing element 22 is provided to prevent central portion 16 from being strongly deformed, in particular from bending or bulging out, due to pressure differentials between the hot gas flowing in the annular duct and the secondary air system outside the annular duct. Reinforcing element 22 includes a first reinforcement portion 24 and a second reinforcement portion 26. As can be seen from FIG. 1, reinforcing element 22 is located in a central or middle region of liner element 10 and of central portion 16 with respect to the circumferential direction. Reinforcing element 22 is spaced from both first connection portion 12 and second connection portion 14. Moreover, reinforcing element 22 is also spaced from edge portions 18. In other words, it may be said that reinforcing element 22 is entirely disposed within outer surface 20 of central portion 16. Thus, reinforcing element 22 is not in direct contact with connecting portions 12, 14 or edge portions 18.

Figure 2:
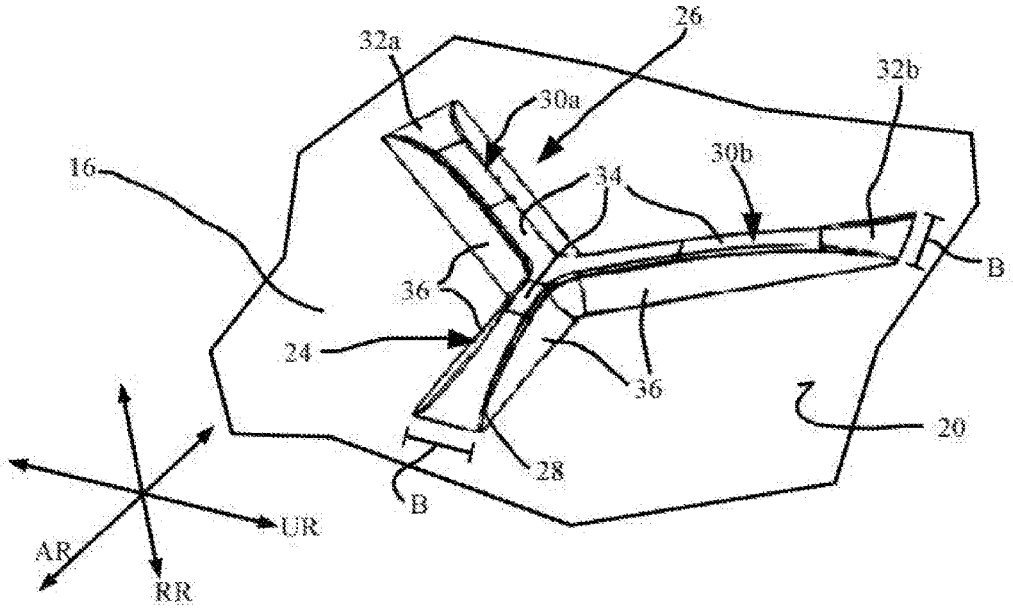
FIG. 2 is an enlarged perspective view of the reinforcing element of FIG. 1.

FIG. 2 shows reinforcing element 22 in an enlarged view. First reinforcement portion 24 extends in the axial direction along outer surface 20 of central portion 16. First reinforcement portion 24 has a free end 28. This free end 28 is configured to taper at least in radial direction RR. In other words, free end 28 of first reinforcement portion 24 is wedge-shaped. This allows for a seamless or smooth transition from first reinforcement portion 24 into outer surface 20 of central portion 16.

Second reinforcement portion 26 includes two arms 30*a* and 30*b*, which extend inclinedly relative to first reinforcement portion 24. Thus, in the present embodiment, reinforcing element 22 is shaped like a Y. Second reinforcement portion 26 has two free ends 32*a*, 32*b*. These free ends 32*a*, 32*b* are also configured to taper in the radial direction. This also allows for a seamless or smooth transition into outer surface 20 of central portion 16. Reinforcing element 22; i.e., its reinforcement portions 24, 26, project from central portion 16; i.e., from outer surface 20, in the radial direction. Reinforcement portions 24, 26 form kind of ribs, which reinforce central portion 16 against bending loads. All reinforcement portions 24, 26 have an upper surface 34, as well as lateral surfaces 36 extending inclinedly or curvedly from the upper surface to outer surface 20 of central portion 16. Surface 34 has a maximum width B at each of the respective free ends 28, 32*a*, 32*b*. The maximum width is provided in particular in the region of transition from the respective reinforcement portion 24, 26 into outer surface 20.

The continuous transition from the outer surface into reinforcement portions 24, 26 allows for easy manufacture of central portion 16 and liner element 10 using a casting process. Due to the continuous transition in the region of free ends 28, 32*a*, 32*b*, reinforcing element 22 is formed only within outer surface 22, without direct contact to other, in particular load-bearing structural components, such as, for example, connecting portions 12, 14 or edge portions 18.

Figure 3:
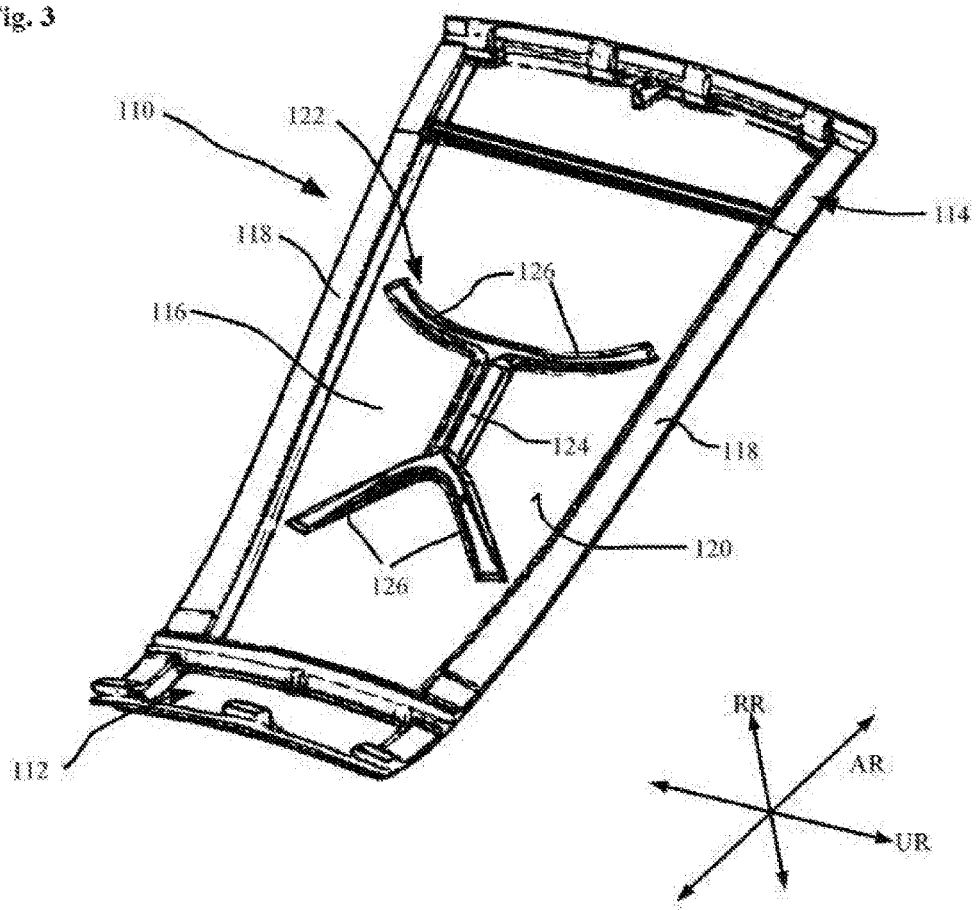
FIG. 3 is a simplified perspective view of another liner element which has a different reinforcing element.

FIG. 3 shows a slightly differently configured liner element 110, namely a so-called "outer duct panel;" i.e., a liner element which is adapted to radially outwardly bound the hot gas duct of the turbine intermediate case. FIG. 3 shows the surface of the liner element which faces away from the hot gas duct and which, when installed, faces radially outwardly relative to the machine axis of the gas turbine. Liner element 110 likewise includes a first, axially forward connecting portion 112 and a second, axially rearward connecting portion 114. Also shown are central portion 116 and edge portions 118. A reinforcing element 122 is disposed in central portion 116. This reinforcing element includes a first reinforcement portion 124 and two second reinforcement portions 126. This reinforcing element 122 is also disposed within outer surface 120 of central portion 116. Thus, it is spaced from connecting portions 112 and 114 and from edge portions 118.

Figure 4:
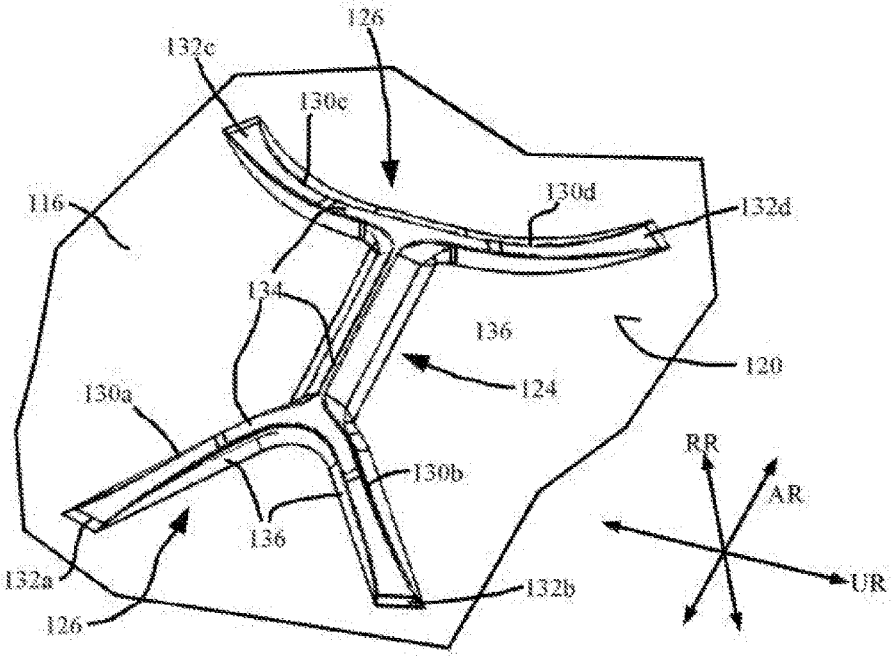
FIG. 4 is an enlarged perspective view of the other reinforcing element of FIG. 3.

FIG. 4 shows reinforcing element 122 in an enlarged view. In this embodiment, reinforcement portion 124 has no free end, but is connected to a second reinforcement portion 126 at both ends. The axially forward (second) reinforcement portion 126 in FIG. 4 has two substantially straight arms 130*a* and 130*b* having respective free ends 132*a* and 132*b*. The two arms 132*a* and 132*b* extend inclinedly relative to the straight first reinforcement portion 124.

The axially rearward (second) reinforcement portion 126 in FIG. 4 has two curved arms 130*c* and 130*d*. These arms 130*c* and 130*d* likewise have free ends 132*c* and 132*d*. What has been said above with respect to the tapering configuration of the free ends (wedge shape) making reference to FIGS. 1 and 2 applies analogously also to free ends 132*a*, 132*b*, 132*c*, 132*c*. Reinforcing element 122 also has an upper surface 134 and lateral surfaces 136 which extend inclinedly or curvedly relative thereto and merge into outer surface 120 of the central portion.

The differently configured second reinforcement portions 126 shown in FIGS. 3 and 4, one with straight arms 130*a*, 130*b* and the other with curved arms 130*c*, 130*d*, could also be interchanged. Moreover, two second reinforcement portions 126 of the same type could be connected to first reinforcement portion 124. Finally, it is also conceivable that instead of the second reinforcement portion 26 with straight arms 30*a*, 30*b* in FIG. 1, a second reinforcement portion configured with curved arms (FIG. 4) could be provided. With regard to the configuration of reinforcing element 22, 122 and its reinforcement portions 24, 124, 26, 126, it is also possible to consider other options not described herein. For example, it would also be conceivable for an arm to have a combination of a curvature and a straight-line extent. In all embodiments, including ones not shown here, it is advantageous if the free ends of the reinforcement portions are configured to taper and merge seamlessly or smoothly into the outer surface of the central portion. Furthermore, any reinforcing elements embodied in other ways should also be spaced apart from the connecting portions and the edge portions of the liner element.

The here presented liner element having a stiffening element makes it possible to provide sufficient stiffness for the central portion and the liner element using little material. Moreover, the thermally induced stresses in the liner element, in particular in the connecting portions and the edge portions, can be kept low because the reinforcing element is not directly connected to these portions.

LIST OF REFERENCE NUMERALS

10, 110 liner element
12, 112 first, axially forward connecting portion
14, 114 second, axially rearward connecting portion
16, 116 central portion
18, 118 edge portion
20, 120 outer surface
22, 122 reinforcing element
24, 124 first reinforcement portion
26, 126 second reinforcement portion
28 free end of the first reinforcement portion
30*a*, 30*b*, 130*a*, 130*b*, 130*c*, 130*d* arms of the second reinforcement portion
32*a*, 32*b*, 132*a*, 132*b*, 132*c*, 132*d* free ends of the second reinforcement portion
34, 134 upper surface
36, 136 lateral surface
100 intermediate turbine case of a gas turbine
101 axially forward components
102 axially rearward components
103 hot-gas-conveying duct
B width
AR axial direction
RR radial direction
UR circumferential direction

What is claimed is:

1. A liner element of a hot-gas-conveying duct of a turbine intermediate case of a gas turbine, the liner element comprising:

a first, axially forward connecting portion;

a second, axially rearward connecting portion;

a central portion connected to the first connecting portion and the second connecting portion and located therebetween in the axial direction; the central portion having an outer surface facing away from the duct; and the first connecting portion being couplable to axially forward components of the turbine intermediate case or gas turbine, and the second connecting portion being couplable to axially rearward components of the turbine intermediate case or gas turbine, the central portion having at least one first reinforcement portion projecting in a direction away from the duct and extending substantially straight between an axial forward end and an axial rearward end; at least one of the axial forward and axially rearward ends being adjoined by a second reinforcement portion projecting in a direction away from the duct and extending inclinedly or curvedly relative to a straight-line extent of the first reinforcement portion;

the first reinforcement portion and the second reinforcement portion together forming a reinforcing element; an entirety of the reinforcing element being disposed within the outer surface of the central portion.

2. The liner element as recited in claim 1 wherein the reinforcing element is spaced apart from the first connecting portion and from the second connecting portion.

3. The liner element as recited in claim 1 wherein a free end of the first reinforcement portion not connected to the second reinforcement portion is configured to taper at least in the radial direction such that the first reinforcement portion merges substantially continuously into the outer surface of the central portion.

4. The liner element as recited in claim 1 wherein the second reinforcement portion is configured to be symmetrical with respect to the first reinforcement portion connected thereto.

5. The liner element as recited in claim 4 wherein the first reinforcement portion and the second reinforcement portion form a Y-shaped reinforcing element.

6. The liner element as recited in claim 1 wherein the second reinforcement portion has two free ends configured to taper at least in the radial direction such that the second reinforcement portion merges continuously into the outer surface of the central portion.

7. The liner element as recited in claim 1 wherein the first reinforcement portion is located centrally on the central portion with respect to the circumferential direction.

8. The liner element as recited in claim 1 wherein the first connecting portion, the second connecting portion and the central portion are curved at least in the circumferential direction.

9. The liner element as recited in claim 1 wherein the reinforcing element is spaced in the circumferential direction from lateral edge portions of the liner element projecting from the outer surface of the central portion at least in the radial direction.

10. The liner element as recited in claim 1 wherein the second reinforcement portion disposed at both the axially forward end and the axially rearward end of the first reinforcement portion.

11. The liner element as recited in claim 1 wherein the entirety of the reinforcing element is formed in one piece with the central portion of the liner element.

12. A turbine intermediate case for a gas turbine having a hot-gas-conveying annular duct, comprising a plurality of liner elements as recited in claim 1 facing the annular duct.

13. An aircraft gas turbine comprising the turbine intermediate case as recited in claim 12.

* * * * *